US011315712B2

(12) United States Patent
Kudo et al.

(10) Patent No.: US 11,315,712 B2
(45) Date of Patent: Apr. 26, 2022

(54) COIL DEVICE

(71) Applicant: TDK CORPORATION, Tokyo (JP)

(72) Inventors: Takashi Kudo, Tokyo (JP); Makoto Morita, Tokyo (JP); Fuyuki Miura, Tokyo (JP)

(73) Assignee: TDK CORPORATION, Tokyo (JP)

( * ) Notice: Subject to any disclaimer, the term of this patent is extended or adjusted under 35 U.S.C. 154(b) by 783 days.

(21) Appl. No.: 16/033,521

(22) Filed: Jul. 12, 2018

(65) Prior Publication Data

US 2019/0027287 A1 Jan. 24, 2019

(30) Foreign Application Priority Data

Jul. 18, 2017 (JP) ..... JP2017-139346

(51) Int. Cl.

| | |
|---|---|
| ***H01F 27/28*** | (2006.01) |
| ***H01F 5/04*** | (2006.01) |
| ***H01F 27/30*** | (2006.01) |
| ***H01F 27/29*** | (2006.01) |
| ***H01F 27/255*** | (2006.01) |
| ***H01F 41/02*** | (2006.01) |

(52) U.S. Cl.

CPC ..... *H01F 5/04* (2013.01); *H01F 27/255* (2013.01); *H01F 27/2828* (2013.01); *H01F 27/29* (2013.01); *H01F 27/292* (2013.01); *H01F 27/306* (2013.01); *H01F 41/0246* (2013.01)

(58) Field of Classification Search

USPC ..... 336/192, 198, 200

See application file for complete search history.

(56) References Cited

U.S. PATENT DOCUMENTS

| | | | | |
|---|---|---|---|---|
| 2003/0206089 | A1* | 11/2003 | Shikama | H01F 17/045 336/221 |
| 2005/0212643 | A1 | 9/2005 | Kuroiwa et al. | |
| 2006/0089022 | A1 | 4/2006 | Sano | |
| 2006/0119461 | A1 | 6/2006 | Kawarai | |
| 2006/0186978 | A1 | 8/2006 | Kawarai | |
| 2006/0186979 | A1 | 8/2006 | Kawarai | |
| 2007/0193022 | A1 | 8/2007 | Kuroiwa et al. | |

(Continued)

FOREIGN PATENT DOCUMENTS

| | | | |
|---|---|---|---|
| CN | 1627457 | A | 6/2005 |
| CN | 102956342 | A | 3/2013 |

(Continued)

*Primary Examiner* — Shawki S Ismail
*Assistant Examiner* — Kazi S Hossain
(74) *Attorney, Agent, or Firm* — Oliff PLC

(57) ABSTRACT

A coil device includes a coil portion, an element body, and a terminal electrode. The coil portion is formed by a wire wound in a coil shape. The element body contains the coil portion where a part of an outer circumference of a lead-out part of the coil portion is exposed as an exposed portion from a bottom surface of the element body and where the rest of the outer circumference of the lead-out part of the coil portion is embedded as an embedded portion in the element body. The terminal electrode is formed on the bottom surface of the element body and connected with the exposed portion. An embedded length of the outer circumference of the lead-out part in the embedded portion is larger than a substantially half of a full length of the outer circumference of the lead-out part.

12 Claims, 10 Drawing Sheets

(56) References Cited

U.S. PATENT DOCUMENTS

| | | | | |
|---|---|---|---|---|
| 2011/0260821 | A1* | 10/2011 | Yamada | H01F 41/10 336/192 |
| 2012/0086534 | A1 | 4/2012 | Wu et al. | |
| 2013/0200972 | A1 | 8/2013 | Wada et al. | |
| 2014/0002227 | A1* | 1/2014 | Hsieh | H01F 41/10 336/200 |
| 2014/0097931 | A1 | 4/2014 | Wu et al. | |
| 2016/0012962 | A1 | 1/2016 | Lee et al. | |
| 2016/0181014 | A1 | 6/2016 | Watanabe et al. | |
| 2016/0217919 | A1* | 7/2016 | Iwata | H01F 27/29 |
| 2016/0247626 | A1* | 8/2016 | Kawarai | H01F 27/24 |
| 2017/0229233 | A1* | 8/2017 | Takagi | H01F 27/29 |
| 2018/0308612 | A1* | 10/2018 | Park | H01F 27/32 |

FOREIGN PATENT DOCUMENTS

| | | | |
|---|---|---|---|
| CN | 103177850 | A | 6/2013 |
| CN | 105719787 | A | 6/2016 |
| JP | 2001-060523 | A | 3/2001 |
| JP | 2003-168610 | A | 6/2003 |
| JP | 2005-210055 | A | 8/2005 |
| JP | 2006-013067 | A | 1/2006 |
| JP | 2006-120887 | A | 5/2006 |

* cited by examiner

COIL DEVICE

BACKGROUND OF THE INVENTION

1. Field of the Invention

The present invention relates to a coil device.

2. Description of the Related Art

Patent Document 1 discloses a coil device where a lead-out part of a coil is disposed on a bottom surface of a core. In the coil device of Patent Document 1, a recess is formed on the bottom surface of the core, and the lead-out part is disposed along the longitudinal direction in the recess. Moreover, a terminal electrode is formed to enter the recess and connected with the lead-out part disposed in the recess. Thus, the lead-out part does not unnecessarily protrude from the bottom surface of the core, and a low profile of the coil device can be achieved.

In the coil device of Patent Document 1, however, the volume of the core is reduced by the volume of the recess, and magnetic characteristics, such as inductance value, may be deteriorated.

Patent Document 1: JP2005210055 (A)

SUMMARY OF THE INVENTION

The present invention has been achieved under such circumstances. It is an object of the invention to provide a low-profile coil device excellent in magnetic characteristics.

To achieve the above object, a coil device according to the present invention comprises:

a coil portion formed by a wire wound in a coil shape;

an element body containing the coil portion where a part of an outer circumference of a lead-out part of the coil portion is exposed as an exposed portion from a bottom surface of the element body and where the rest of the outer circumference of the lead-out part of the coil portion is embedded as an embedded portion in the element body; and a terminal electrode formed on the bottom surface of the element body and connected with the exposed portion, wherein an embedded length of the outer circumference of the lead-out part in the embedded portion is larger than a substantially half of a full length of the outer circumference of the lead-out part.

In the coil device according to the present invention, a part of an outer circumference of a lead-out part of the coil portion is exposed as an exposed portion from a bottom surface of the element body, and the rest of the outer circumference of the lead-out part of the coil portion is embedded as an embedded portion in the element body. In addition, an embedded length of the outer circumference of the lead-out part in the embedded portion is larger than a substantially half of a full length of the outer circumference of the lead-out part.

Thus, a substantially half or more of the lead-out part is embedded in the element body, and there hardly exists an exposed portion of the lead-out part from the bottom surface of the element body, on the transverse plane perpendicular to the longitudinal direction of the lead-out part. Thus, the lead-out part does not unnecessarily protrude from the bottom surface of the element body, and a low profile of the coil device can be achieved.

Preferably, an exposed length of the outer circumference of the lead-out part in the exposed portion is smaller than the substantially half of the full length of the outer circumference of the lead-out part. The lead-out part protruding from the bottom surface of the element body can entirely be removed, but even in this case, an exposed length of the outer circumference of the lead-out part in the exposed portion is smaller than the substantially half of the full length of the outer circumference of the lead-out part.

Preferably, the element body comprises a first layer having a support portion configured to support the coil portion. In this structure, the coil portion is supported by the support portion, and a positional displacement of the coil portion can effectively be prevented in the element body.

Preferably, a step configured to accommodate the lead-out part is formed on a bottom surface of the support portion opposite to its front surface configured to support the coil portion, and a height of the step is smaller than a diameter of the lead-out part. In this structure, when the lead-out part of the coil portion is arranged on the step, the outer circumference of the lead-out part partially protrudes downward from the bottom surface of the support portion. For example, when a second layer is filled in the step so as to be flush with the bottom surface of the support portion, it is possible to form the element body where a part of the outer circumference of the lead-out part is exposed from the bottom surface of the second layer and becomes the exposed portion. The exposed portion, which is part of the outer circumference of the lead-out part, is covered with the terminal electrode and electrically connected therewith.

Preferably, the element body comprises a winding core formed on the front surface of the support portion and configured to be positioned inside the coil portion. In this structure, the coil portion is easily positioned to the winding core, and a positional displacement of the coil portion can effectively be prevented in the element body.

Preferably, the element body comprises a second layer whose permeability is smaller than that of the first layer. In this structure, magnetic saturation characteristics of the element body can be improved. The material constituting the second layer having a small permeability has good flexibility and formability and can be filled in small spaces. Moreover, since the first layer has a large permeability, magnetic properties, such as inductance, of the element body can be improved.

Preferably, the lead-out part comprises a first lead-out part and a second lead-out part extending substantially in parallel to the first lead-out part, the step comprises a first step and a second step, the first lead-out part extends along the first step, and the second lead-out part extends along the second step. The first step and the second step are configured to be filled with the second layer. This structure can easily manufacture the element body where the outer circumferences of the first and second lead-out parts of the coil portion are partially exposed from the bottom surface. The exposed portions, which are part of the outer circumferences of the first and second lead-out parts, are covered with the terminal electrode and electrically connected therewith.

To achieve the above object, a method of manufacturing the coil device according to the present invention comprises the steps of:

providing a first layer with at least one coil portion formed by a wire wound in a coil shape so that a lead-out part of the coil portion is disposed on a bottom surface of the coil device; and forming an element body by covering the first layer with a second layer so that the outer circumference of the lead-out part is partially exposed.

In the method of manufacturing the coil device according to the present invention, the element body is formed by covering the first layer with the second layer so that the outer circumference of the lead-out part is partially exposed. When the coil device is manufactured by this method, it is possible to form the element body where the outer circumference of the lead-out part of the coil portion is partially exposed from a bottom surface of the second layer. The exposed portion, which is part of the outer circumference of the lead-out part, is covered with the terminal electrode and electrically connected therewith. In the method of the present invention, the coil device according to the present invention can easily be manufactured.

The method of the present invention may comprise a step of forming the element body by cutting the first layer covered with the second layer. When the coil device is manufactured by this method, it is possible to form a large number of element bodies at one time where the outer circumference of the lead-out part of the coil portion is partially exposed from the bottom surface of the second layer.

The method of the present invention may comprise a step of forming the terminal electrode on the bottom surface of the element body so that the terminal electrode is connected with a part of the outer circumference of the lead-out part exposed from the bottom surface of the second layer. The method of the present invention may comprise a step of forming the element body by cutting the first layer covered with the second layer after the terminal electrode is formed on the bottom surfaces of the first layer and the second layer so as to be connected with a part of the outer circumference of the lead-out part exposed from the bottom surface of the second layer. When the coil device is manufactured by this method, it is possible to easily obtain the element body with the terminal electrode and to improve manufacturing efficiency of the coil device.

The first layer includes a passage where the lead-out part passes and may be covered with the second layer by flowing a resin constituting the second layer via the passage. When the coil device is manufactured by this method, the first layer can easily be covered with the second layer.

The bottom surface of the first layer may include a step configured to accommodate the lead-out part and recessed against a main surface to be a mounting surface with a predetermined height, and the resin constituting the second layer may be present via the passage in the space between the step and a sheet where the main surface of the first layer is placed. The step has a height that is smaller than an outer diameter of the lead-out part. Thus, a part of the outer circumference of the lead-out part protruding from the step bites into the surface of the sheet. Thus, the outer circumference of the lead-out part is not entirely covered with the resin constituting the second layer during the flow of the resin constituting the second layer, and it is possible to easily form the element body where the outer circumference of the lead-out part is partially exposed from the bottom surface of the second layer.

Preferably, the passage is a through hole or a notch formed in the first layer. In this structure, the resin constituting the second layer can easily flow from the front surface to the rear surface of the first layer (alternatively, from the rear surface to the front surface of the first layer) via the through hole or the notch. As a result, the second layer can cover most of the first layer. The second layer, however, may not cover the main surface to be a mounting surface of the bottom surface of the first layer.

DETAILED DESCRIPTION OF THE PREFERRED EMBODIMENT

Hereinafter, the present invention is described based on an embodiment shown in the figures.

Figure 1A:
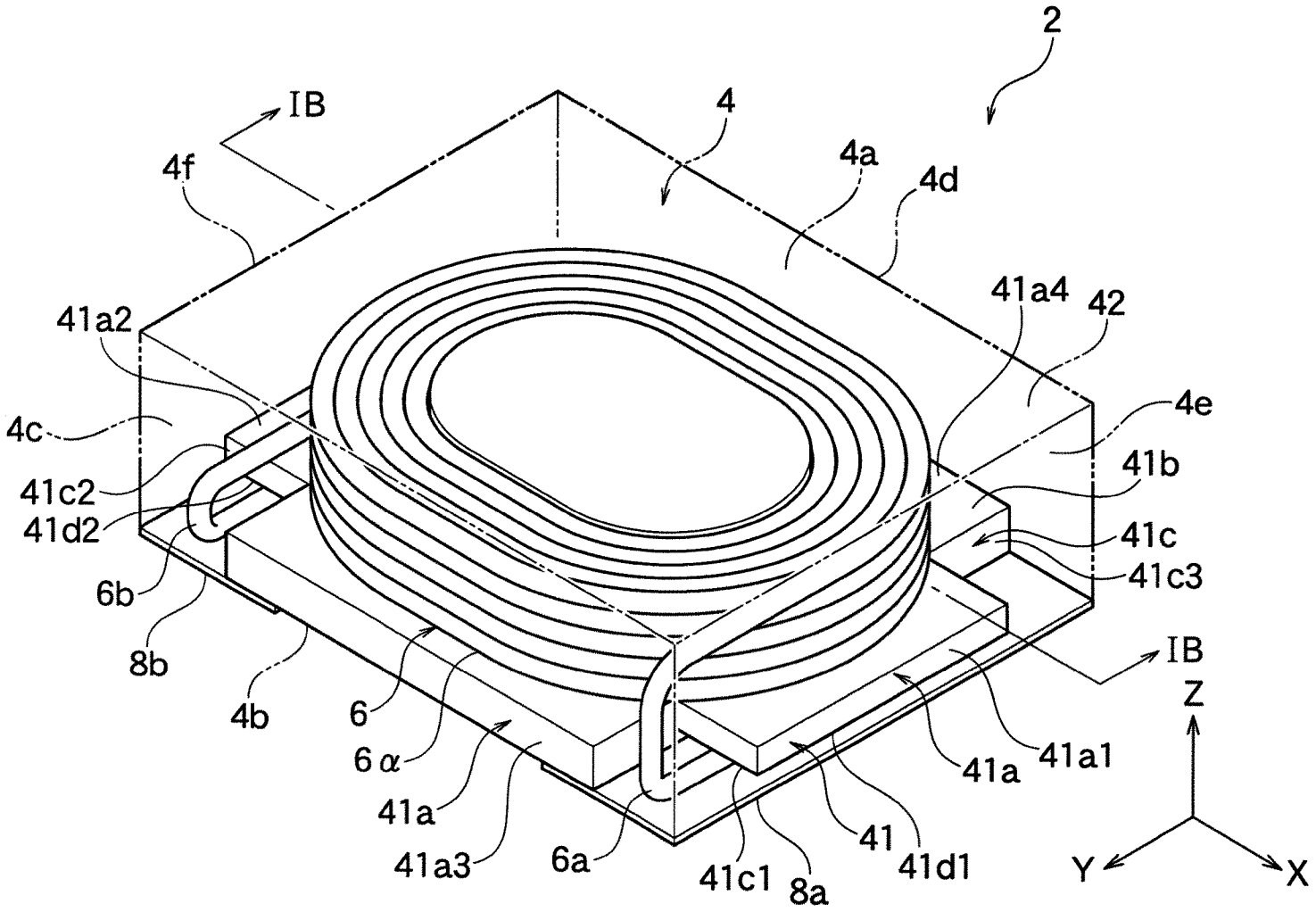
FIG. 1A is a perspective view of a coil device according to an embodiment of the present invention

As shown in FIG. 1A, an inductor 2 as a coil device (chip component) according to an embodiment of the present invention has an element body 4 having an approximately rectangular-parallelopiped shape (approximately hexahedron shape). Incidentally, the coil device of the present invention is not limited to the inductor 2, and may be another coil device.

The element body 4 has a top surface 4*a*, a bottom surface 4*b* (a main surface to be a mounting surface) opposite to the top surface 4*a* in the Z-axis direction, and four side surfaces 4*c* to 4*f* The element body 4 has any size. For example, the element body 4 preferably has a length (X-axis) of 1.2 to 6.5 mm, preferably has a width (Y-axis) of 0.6 to 6.5 mm, and a height (Z-axis) of 0.5 to 5.0 mm.

The element body 4 contains a wire 6 as a conductor wound in a coil shape. In the present embodiment, for example, the wire 6 is formed by a round wire of a copper wire covered with an insulating film. This insulating film is an epoxy modified acrylic resin or so. The wire 6 is wound in a coil shape by one or more turns (5×5 turns in the illustrated example) in the element body 4, and a coil portion 6α is thereby formed.

In the present embodiment, the coil portion 6α is formed by an air-core coil where the wire 6 is wound by an ordinary normal wise, but may be formed by an air-core coil where the wire 6 is wound by α-winding or by an air-core coil where the wire 6 is wound by an edge wise. Instead, the wire 6 may directly be wound around a winding core 41*b* mentioned below. A first lead-out part 6*a* is formed at one end of the wire 6, and a second lead-out part 6*b* is formed at the other end of the wire 6.

Figure 1B:
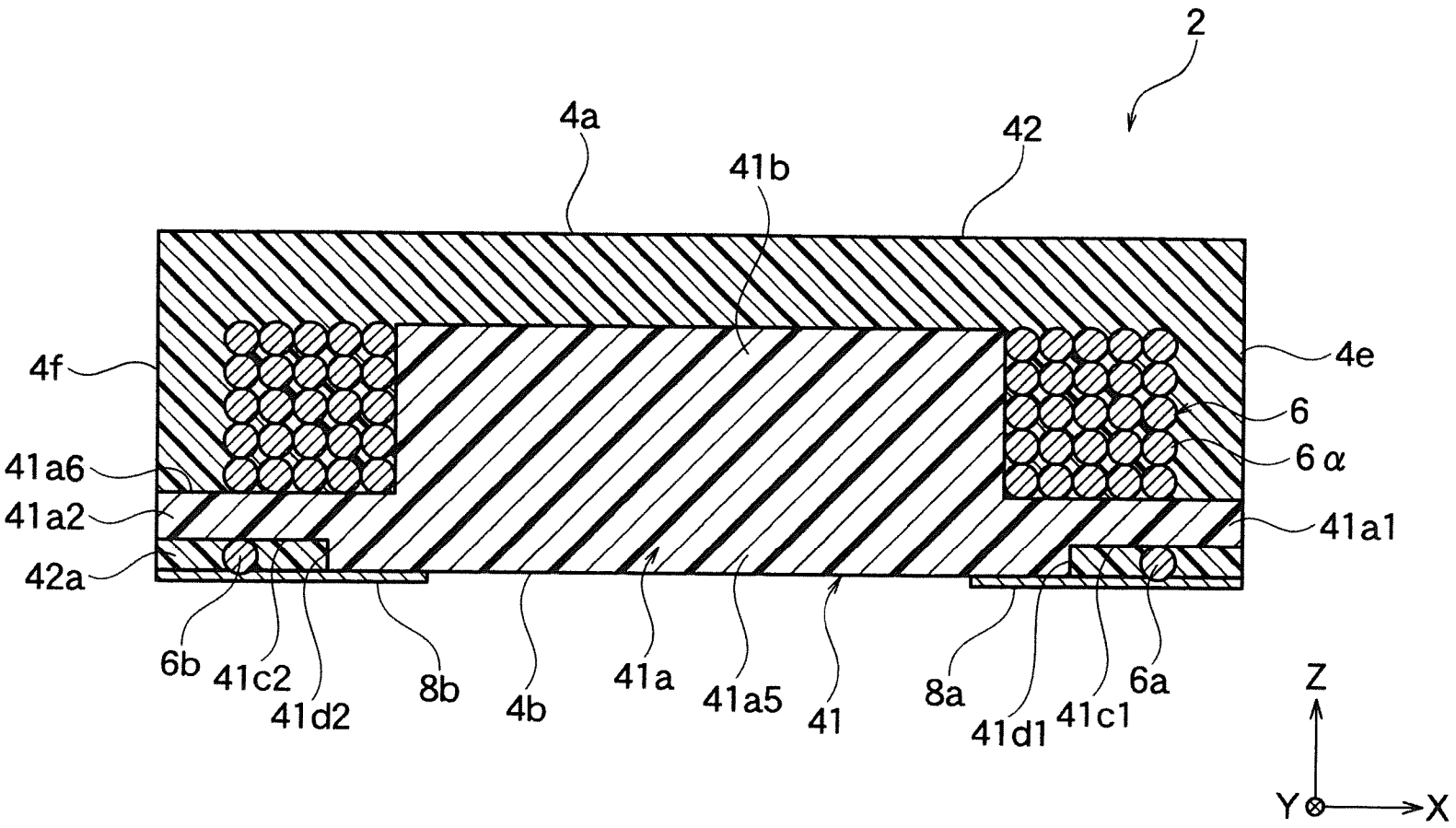
FIG. 1B is a cross-sectional view of the coil device along the IB-IB line shown in FIG. 1A.
Figure 1C:
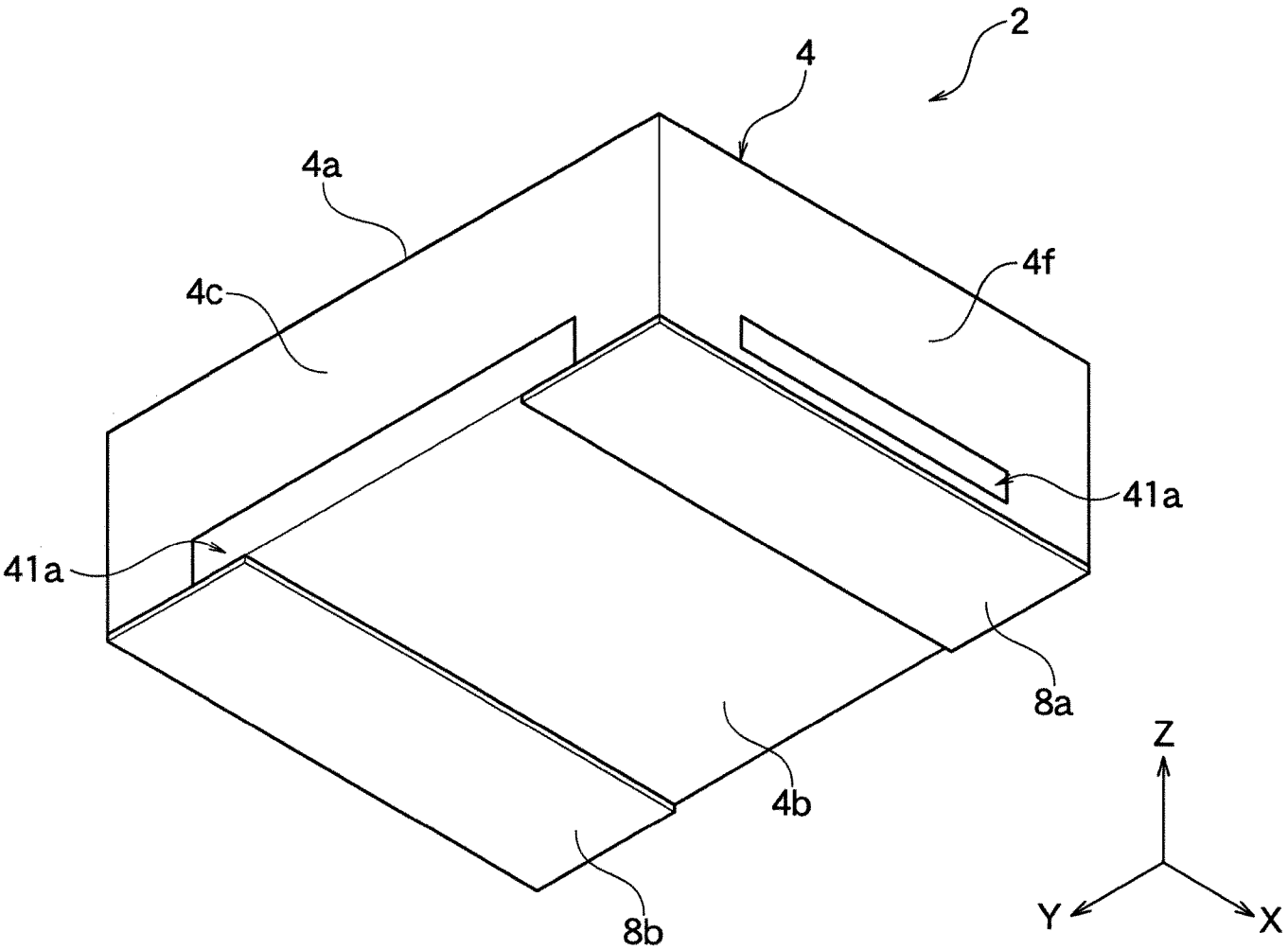
FIG. 1C is a perspective view of the coil device shown in FIG. 1A from the side of a mounting surface.

As shown in FIG. 1A and FIG. 1B, the element body 4 of the present embodiment has a first layer 41 and a second layer 42. For example, the first layer 41 and the second layer 42 may be formed by the same kind of material, and relative permeability μ1 of the first layer 41 and relative permeability μ2 of the second layer 42 may be equal to each other, but relative permeability μ2 of the second layer 42 may be smaller than relative permeability μ1 of the first layer 41. Relative permeability μ1 of the first layer 41 is not limited, but is 20 to 50 for example.

In the present embodiment, the first layer 41 and the second layer 42 of the element body 4 are preferably composed of a magnetic material and contain, for example, ferrite particles or metal magnetic particles. The ferrite particles are Ni—Zn based ferrite, Mn—Zn based ferrite, or the like. The metal magnetic particles are not limited, and are Fe—Ni alloy powder, Fe—Si alloy powder, Fe—Si—Cr alloy powder, Fe—Co alloy powder, Fe—Si—Al alloy powder, amorphous iron, or the like.

The first layer 41 and the second layer 42 of the element body 4 may contain a synthetic resin. This synthetic resin is not limited, and is an epoxy resin, a phenol resin, a polyester resin, a polyurethane resin, a polyimide resin, or the like.

As shown in FIG. 1A, the first layer 41 has a support portion 41*a*, the winding core 41*b*, notches 41*c*, and steps 41*d*. The support portion 41*a* has a first flange 41*a*1 protruding toward the side surface 4*e* of the element body 4 in the X-axis direction, a second flange 41*a*2 protruding toward the side surface 4*f* of the element body 4 in the X-axis direction, a third flange 41*a*3 protruding toward the side surface 4*c* of the element body 4 in the Y-axis direction, and a fourth flange 41*a*4 protruding toward the side surface 4*d* of the element body 4 in the Y-axis direction. As shown in FIG. 1B, the support portion 41*a* has a main body 41*a*5 formed approximately at the center of the support portion 41*a* and surrounded by the first flange 41*a*1 to the fourth flange 41*a*4.

As shown in FIG. 1A and FIG. 1B, the coil portion 6α can be placed on the first flange 41*a*1 to the fourth flange 41*a*4 and the main body 41*a*5. That is, the support portion 41*a* can support the coil portion 6α. The flanges 41*a*1 and 41*a*2 are formed to be thinner than the flanges 41*a*3 and 41*a*4. The flanges 41*a*3 and 41*a*4 are as thick as the main body 41*a*5.

The winding core 41*b* is formed on the surface of the support portion 41*a* in the Z-axis direction and is formed integrally with the support portion 41*a* (more precisely, the main body 41*a*5). The winding core 41*b* has a substantially elliptic cylinder shape protruding upward and is inserted in the coil portion 6α disposed on the support portion 41*a*. In the present embodiment, the coil portion 6α previously wound by the wire 6 is fixed around the winding core 41*b*, but the coil portion 6α may be fixed around the winding core 41*b* by winding the wire 6 around the winding core 41*b*. Incidentally, as shown in FIG. 1E, the flanges 41*a*1 to 41*a*4 may further be formed at the upper part of the winding core 41*b*. Incidentally, the flanges 41*a*3 and 41*a*4 are not illustrated in FIG. 1E.

The notch 41*c* has a first notch 41*c*1 formed around an intersection between the side surfaces 4*c* and 4*e* of the element body 4, a second notch 41*c*2 formed around an intersection between the side surfaces 4*c* and 4*f* of the element body 4, a third notch 41*c*3 formed around an intersection between the side surfaces 4*d* and 4*e* of the element body 4, and a fourth notch 41*c*4 (not shown) formed around an intersection between the side surfaces 4*d* and 4*f* of the element body 4. In the illustrated example, the notches 41*c*1 to 41*c*4 are notched in a substantially square shape, but may be notched in another shape or may be a through hole going through the front and rear surfaces.

In the present embodiment, lead-out parts 6*a* and 6*b* drawn from the coil portion 6α passes through the first notch 41*c*1 and the second notch 41*c*2. That is, the first notch 41*c*1 and the second notch 41*c*2 are mainly utilized as a passage where the lead-out parts 6*a* and 6*b* passes. As described below, the first notch 41*c*1 and the second notch 41*c*2 also function together with the other notches 41*c*3 and 41*c*4 as a passage where a molding material constituting the second layer 42 flows from the front surface to the rear surface of the first layer 41.

The steps 41*d* are formed on the bottom surface of the support portion 41*a* opposite to the surface configured to support the coil portion 6α, namely, on the bottom surface of the first layer 41. The steps 41*d* have a first step 41*d*1 formed close to the side surface 4*e* of the element body 4 and a second step 41*d*2 formed close to the side surface 4*f* of the element body 4. The first step 41*d*1 is formed under the first flange 41*a*1, and the second step 41*d*2 is formed under the second step 41*a*2. Since the flanges 41*a*1 and 41*a*2 are formed to be thinner than the flanges 41*a*3 and 41*a*4 as described above, the steps 41*d*1 and 41*d*2 are formed under the flanges 41*a*1 and 41*a*2 in the Z-axis direction.

Figure 1D:
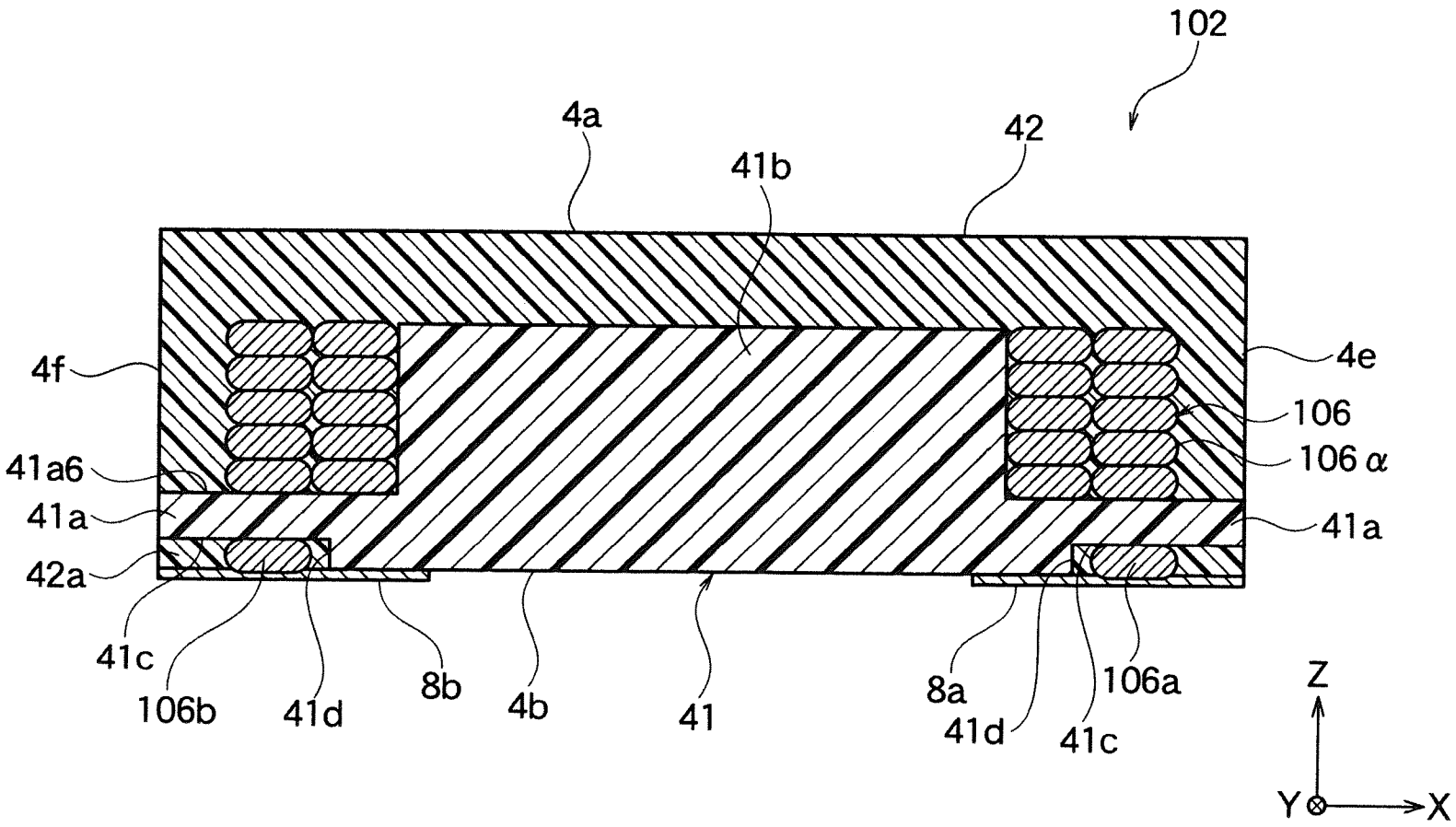
FIG. 1D is a cross-sectional view showing a variation of the coil device shown in FIG. 1B.
Figure 1E:
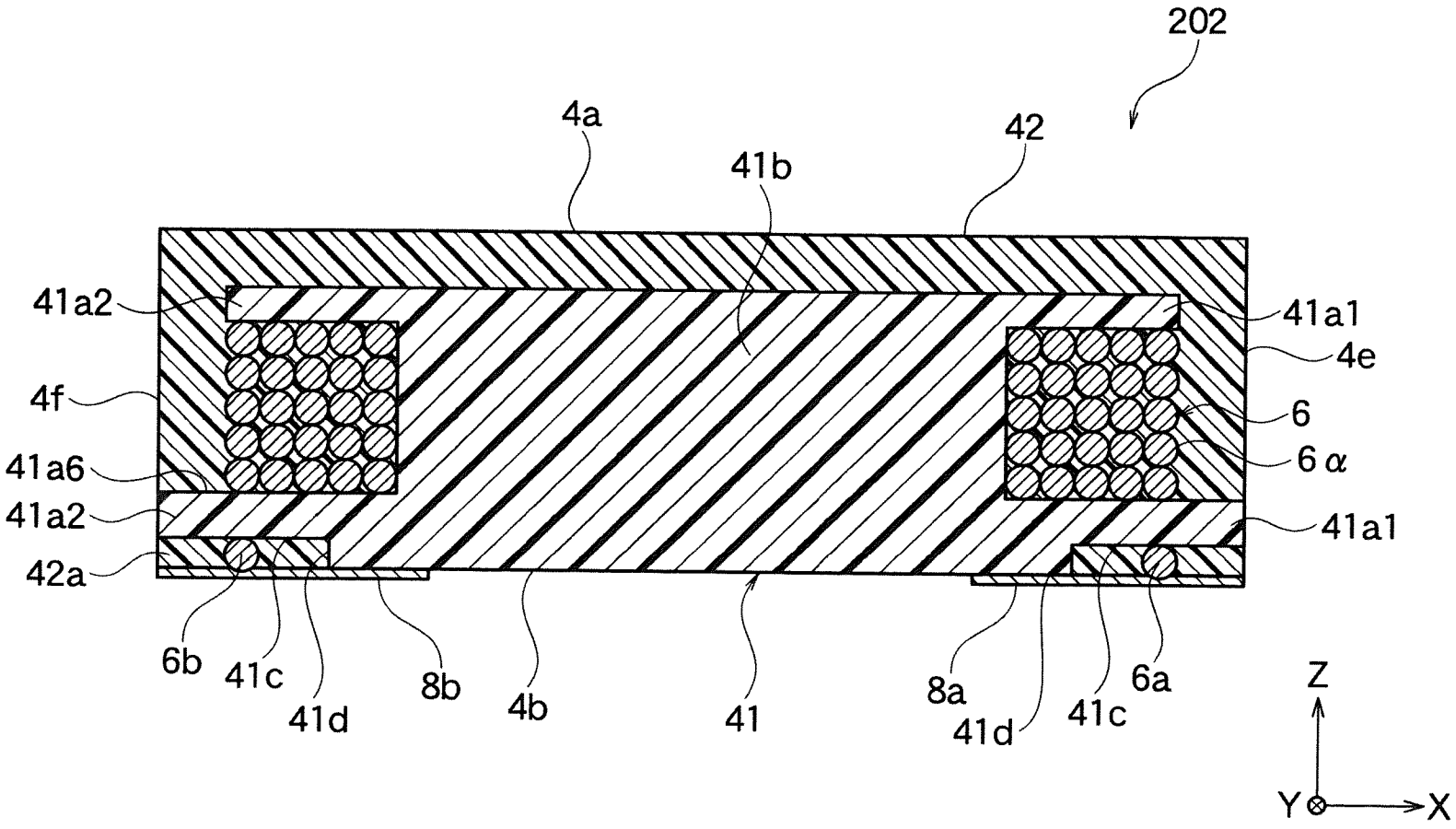
FIG. 1E is a cross-sectional view showing another variation of the coil device shown in FIG. 1B.
Figure 1F:
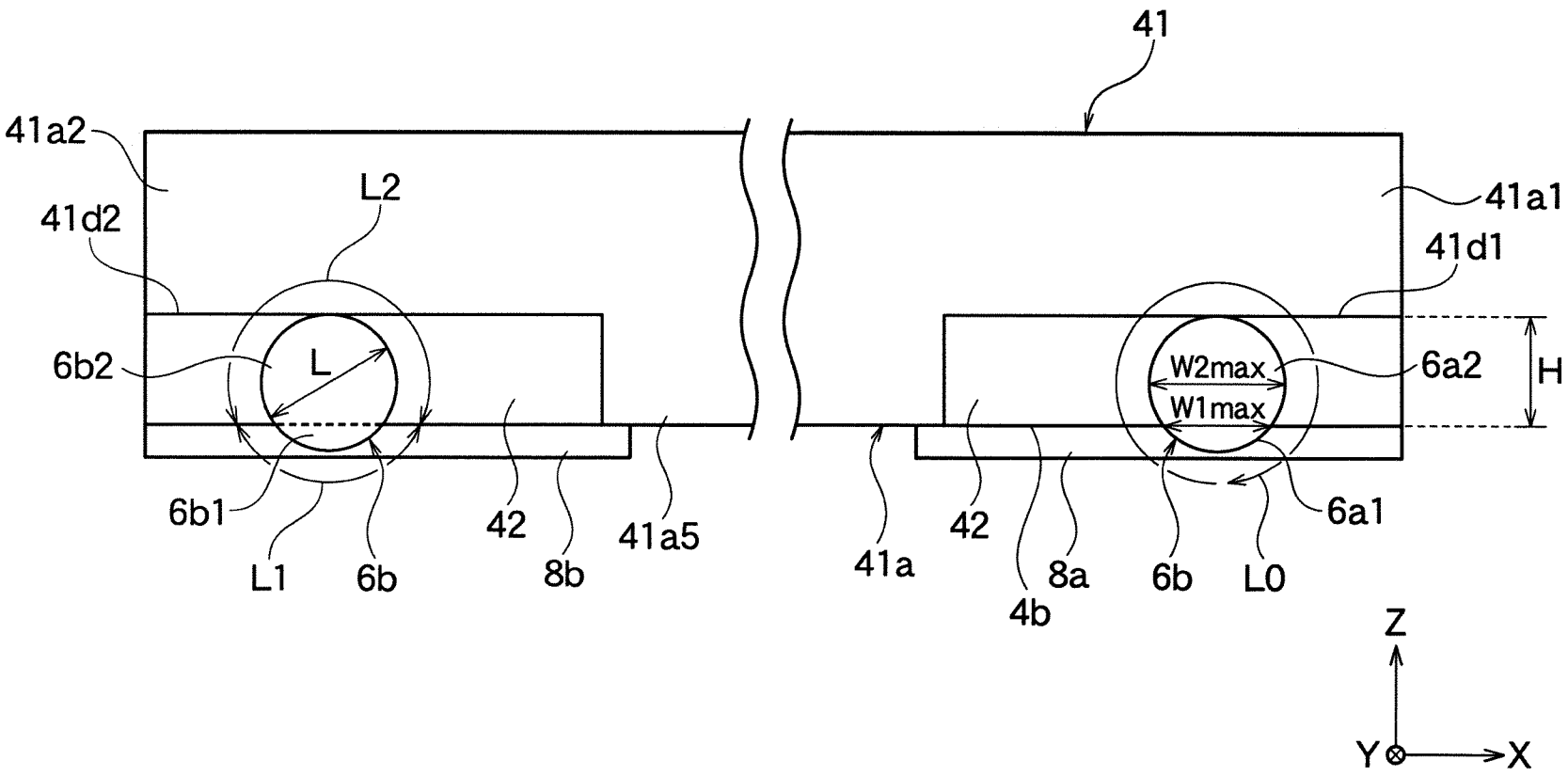
FIG. 1F is a partially enlarged cross-sectional view of the coil device shown in FIG. 1B.

As shown in FIG. 1F, the height H of the steps 41*d*1 and 41*d*2 is smaller than the outer diameter L of the lead-out parts 6*a* and 6*b*. Thus, when the lead-out parts 6*a* and 6*b* of the coil portion 6α are arranged on the steps 41*d*1 and 41*d*2, a part of outer circumferences of the lead-out parts 6*a* and 6*b* is contained in the steps 41*d*1 and 41*d*2, and the rest of the outer circumferences of the lead-out parts 6*a* and 6*b* protrudes outside the steps 41*d*1 and 41*d*2 and is positioned below the bottom surface of the main body 41*a*5 (support portion 41*a*). Incidentally, the lead-out parts 6*a* and 6*b* are arranged in the steps 41*d*1 and 41*d*2 while their outer circumferences are partially in contact with the lower surfaces of the flanges 41*a*1 and 41*a*2. The height H of the steps 41*d*1 and 41*d*2 is determined as follows based on the outer diameter L of the lead-out parts 6*a* and 6*b*.

As shown in FIG. 1A, the lead-out parts 6*a* and 6*b* drawn from the coil portion 6α extend mutually in parallel in the Y-axis direction and are drawn to the vicinity of the side surface 4*c* of the element body 4. The lead-out parts 6*a* and 6*b* bend in the Z-axis direction in the vicinity of the side surface 4*c* of the element body 4 and are drawn to the vicinity of the side surface 4*b* of the element body 4. In the vicinity of the bottom surface 4*b* of the element body 4, the lead-out parts 6*a* and 6*b* then pass through the notches 41*c*1 and 41*c*2, bend in the Y-axis direction, extend along the steps 41*d*1 and 41*d*2, and are drawn to the ends of the steps 41*d*1 and 41*d*2 near the side surface 4*d* in the Y-axis direction.

When the lead-out parts 6*a* and 6*b* of the coil portion 6α pass through the notches 41*c*1 and 41*c*2, the lead-out parts 6*a* and 6*b* of the coil portion 6α are drawn toward the opposite direction to the drawn direction from the coil portion 6α on the support portion 41*a* (turned over by about 180°) into the steps 41*d*1 and 41*d*2 of the bottom surfaces of the flanges 41*a*1 and 41*a*2.

As shown in FIG. 1B, the second layer 42 covers the first layer 41. For more detail, the second layer 42 covers the upper part of the support portion 41*a* and is filled, as a filling layer 42*a*, in the notch 41*c* and the steps 41*d*1 and 41*d*2, and the second layer 42 does not cover the bottom surface 4*b* of the support portion 41*a*.

The second layer 42 is filled in the steps 41*d*1 and 41*d*2 so as to substantially be flush with the bottom surface of the main body 41*a*5 (support portion 41*a*). In the present embodiment, the lead-out parts 6*a* and 6*b* of the coil portion 6α thereby partially protrude from the bottom surface 4*b* of the second layer 42.

In the present embodiment, as shown in FIG. 1F, a part of the outer circumferences of the lead-out parts 6*a* and 6*b* is thereby exposed from the bottom surface of the second layer 42 of the element body 4 as exposed portions 6*a*1 and 6*b*1, and the rest of the outer circumferences of the lead-out parts 6*a* and 6*b* is embedded in the second layer 42 of the element body 4 as embedded portions 6*a*2 and 6*b*2.

The length L2 of the outer circumferences of the lead-out parts 6*a* and 6*b* in the embedded portions 6*a*2 and 6*b*2 is larger than a substantially half of the length L0 of the outer circumferences of the lead-out parts 6*a* and 6*b*. The length L1 of the outer circumferences of the lead-out parts 6*a* and 6*b* in the exposed portions 6*a*1 and 6*b*1 is smaller than a substantially half of the length L0 of the outer circumferences of the lead-out parts 6*a* and 6*b*. The ratio L1/L of the length L1 of the outer circumferences of the lead-out parts 6*a* and 6*b* in the exposed portions 6*a*1 and 6*b*1 to the length L of the outer circumferences of the lead-out parts 6*a* and 6*b* is preferably 5 to 49%, more preferably 25 to 40%.

In the illustrated example, the length L2 of the outer circumferences of the lead-out parts 6*a* and 6*b* in the embedded portions 6*a*2 and 6*b*2 is larger than the length L1 of the outer circumferences of the lead-out parts 6*a* and 6*b* in the exposed portions 6*a*1 and 6*b*1. The volume V2 of the lead-out parts 6*a* and 6*b* in the embedded portions 6*a*2 and 6*b*2 is larger than the volume V1 of the lead-out parts 6*a* and 6*b* in the embedded portions 6*a*2 and 6*b*2.

The maximum width W2max of the lead-out parts 6*a* and 6*b* in the X-axis direction in the embedded portions 6*a*2 and 6*b*2 is larger than the maximum width W1max of the lead-out parts 6*a* and 6*b* in the X-axis direction in the exposed portions 6*a*1 and 6*b*1.

Incidentally, the lead-out parts 6*a* and 6*b* exposed from the bottom surface 4*b* of the element body 4 may partially or entirely be removed. In this case, the exposed portion 6*a*1 is formed along the bottom surface 4*b* of the second layer 42 of the element body 4.

As shown in FIG. 1A and FIG. 1B, a first terminal electrode 8*a* is formed on one end of the bottom surface 4*b* of the element body 4 in the X-axis direction (near the side surface 4*e*) so as to range the first layer 41 and the second layer 42, and a second terminal electrode 8*b* is formed on the other end of the bottom surface 4*b* in the X-axis direction (near the side surface 4*f*) so as to range the first layer 41 and the second layer 42. Incidentally, the terminal electrodes 8*a* and 8*b* may be formed only on the bottom surface 4*b* of the second layer 42 without ranging the first layer 41 or the second layer 42.

Unlike a normal electronic device where a terminal electrode is also formed on a side surface, the first terminal electrode 8*a* may be formed only on the bottom surface 4*b* without ranging the side surfaces 4*c* to 4*e* of the element body 4 in the present embodiment. The first terminal electrode 8*a* has an elongated shape in the Y-axis direction and covers one end of the bottom surface 4*b* in the Y-axis direction near the side surface 4*c* to the other end of the bottom surface 4*b* in the Y-axis direction near the side surface 4*d*. As shown in FIG. 1B, the first terminal electrode 8*a* covers a part (exposed portion 6*a*1) of the outer circumference of the first lead-out part 6*a* exposed from the bottom surface 4*b* and is electrically connected with the first lead-out part 6*a*.

Likewise, unlike a normal electronic device where a terminal electrode is also formed on a side surface, the second terminal electrode 8*b* may be formed only on the bottom surface 4*b* without ranging the side surfaces 4*b* to 4*d* or 4*f* of the element body 4 in the present embodiment. The second terminal electrode 8*b* has an elongated shape in the Y-axis direction and covers one end of the bottom surface 4*b* in the Y-axis direction near the side surface 4*c* to the other end of the bottom surface 4*b* in the Y-axis direction near the side surface 4*d*. The second terminal electrode 8*b* covers a part (exposed portion 6*b*1) of the outer circumference of the second lead-out part 6*b* exposed from the bottom surface 4*b* and is electrically connected with the second lead-out part 6*b*.

The terminal electrodes 8*a* and 8*b* are formed by a multilayer electrode film of a base electrode film and a plating film, for example. The plating film may be formed on the base electrode film constituted by a conductive paste film containing a metal of Sn, Ag, Ni, C, etc. or an alloy of these metals. In this case, the plating film is formed after the base electrode film is formed and thereafter subjected to a dry treatment or a heat treatment. For example, the plating film is a metal of Sn, Au, Ni, Pt, Ag, Pd, etc. or an alloy of these metals. Incidentally, the terminal electrodes 8*a* and 8*b* may be formed by sputtering. Preferably, the thickness of the terminal electrodes 8*a* and 8*b* is 3 to 30 μm and is about ⅓ of the height H of the step.

Next, described is a method of manufacturing the inductor 2 of the present embodiment. In the method of the present embodiment, initially prepared are a first-layer molded body 410 corresponding to the above-mentioned first layer 41 shown in FIG. 2A(a) and a plurality (16 in the present embodiment) of coil portions 6α wound in air-core coil shown in FIG. 2B(a).

Figure 2A:
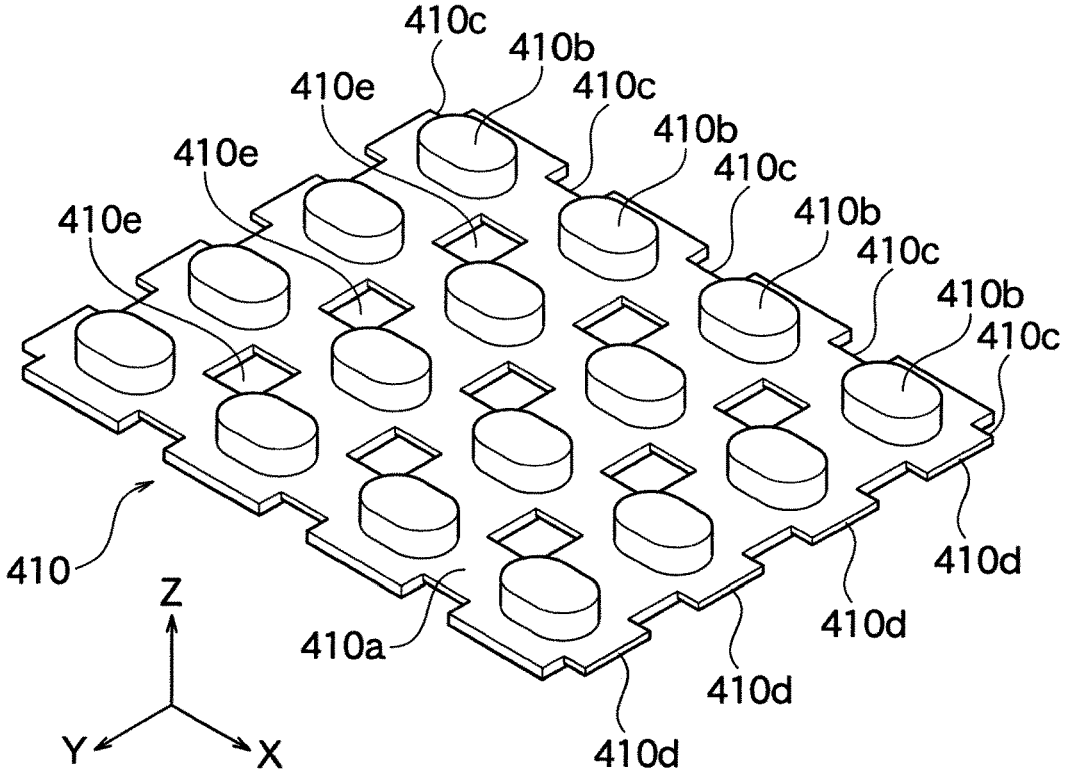
FIG. 2A(a) and FIG. 2A(b) are a perspective view showing a process of manufacturing the coil device.
Figure 2A:
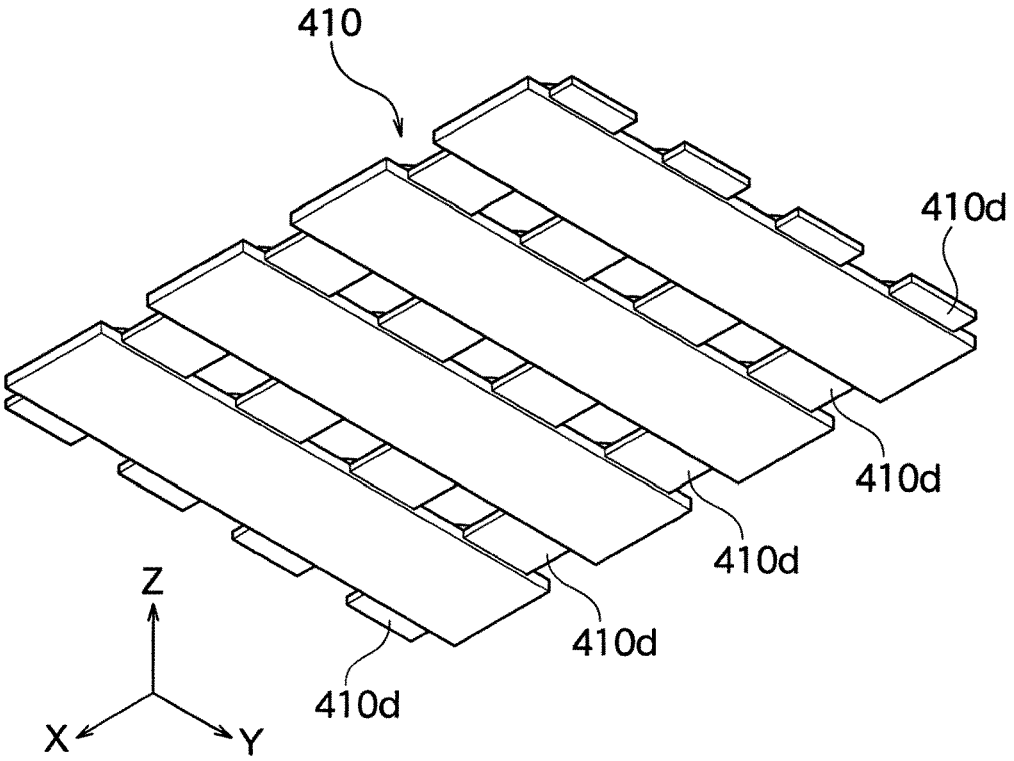

As shown in FIG. 2A(a), the first-layer molded body 410 is constituted by connecting a plurality (16 in the present embodiment) of first layers 41 mentioned above. The first-layer molded body 410 can be obtained by powder forming, injection molding, cutting out processing, or the like. The first-layer molded body 410 has a high molding density and can be constituted by a material having a high permeability.

The first-layer molded body 410 has a support portion 410*a*, a plurality (16 in the present embodiment) of winding cores 410*b*, a plurality (16 in the present embodiment) of notches 410*c* formed on the outer periphery of the support portion 410*a*, a plurality (20 in the present embodiment) of steps 410*d*, and a plurality (nine in the present embodiment) of through holes 410*e* formed in the support portion 410*a*.

The support portion 410*a* is constituted by connecting the above-mentioned support portions 41*a*. As described below, the notches 410*c* and the through holes 410*e* are utilized as a passage where a resin constituting a second layer 420 flows in a molding die 7 (see FIG. 2C). The steps 410*d* shown in FIG. 2A(a) are mainly utilized for arrangement of the lead-out parts 6*a* and 6*b* of the coil portions 6α.

The winding cores 410*b* shown in FIG. 2A(a) are arranged in lattice so that the intervals of the winding cores 410*b* adjacent to each other in the X-axis direction and the intervals of the winding cores 410*b* adjacent to each other in the Y-axis direction are approximately the same. The through holes 410*e* are arranged in lattice so that the intervals of the through holes 410*e* adjacent to each other in the X-axis direction and the intervals of the through holes 410*e* adjacent to each other in the Y-axis direction are approximately the same.

Figure 2B:
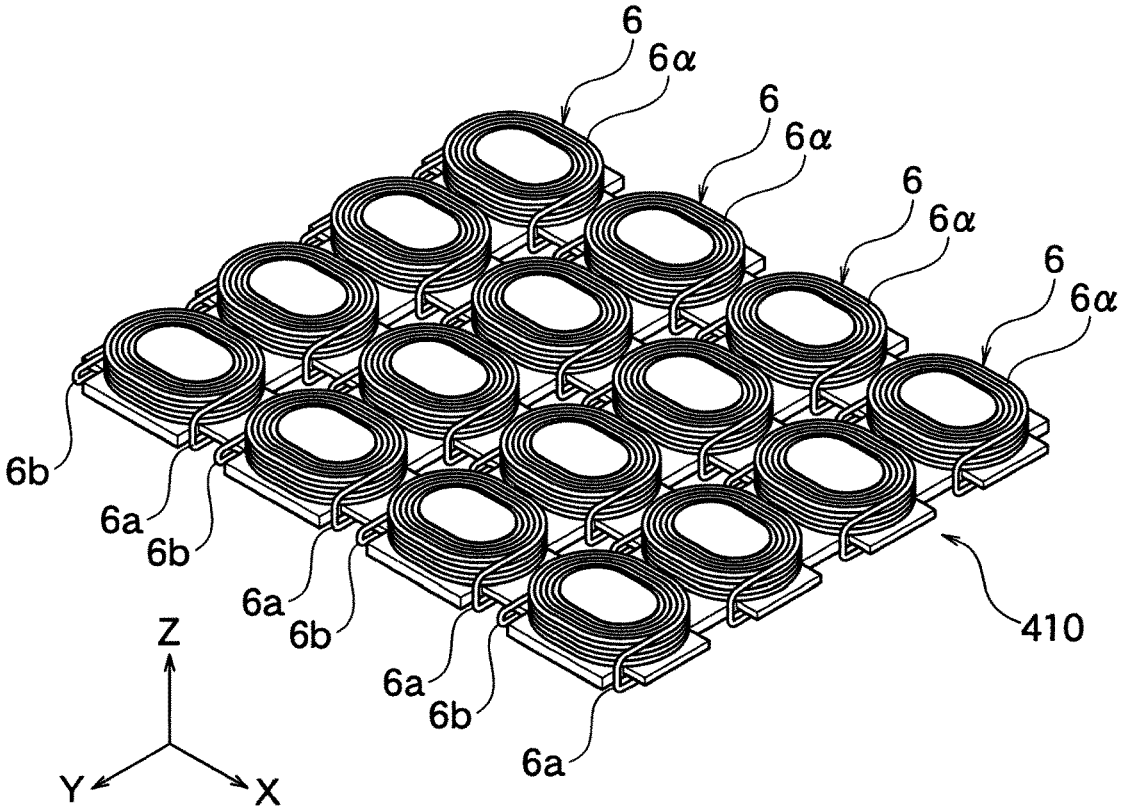
FIG. 2B(a) and FIG. 2B(b) are a perspective view showing the next step of FIG. A(a) and FIG. 2A(b).
Figure 2B:
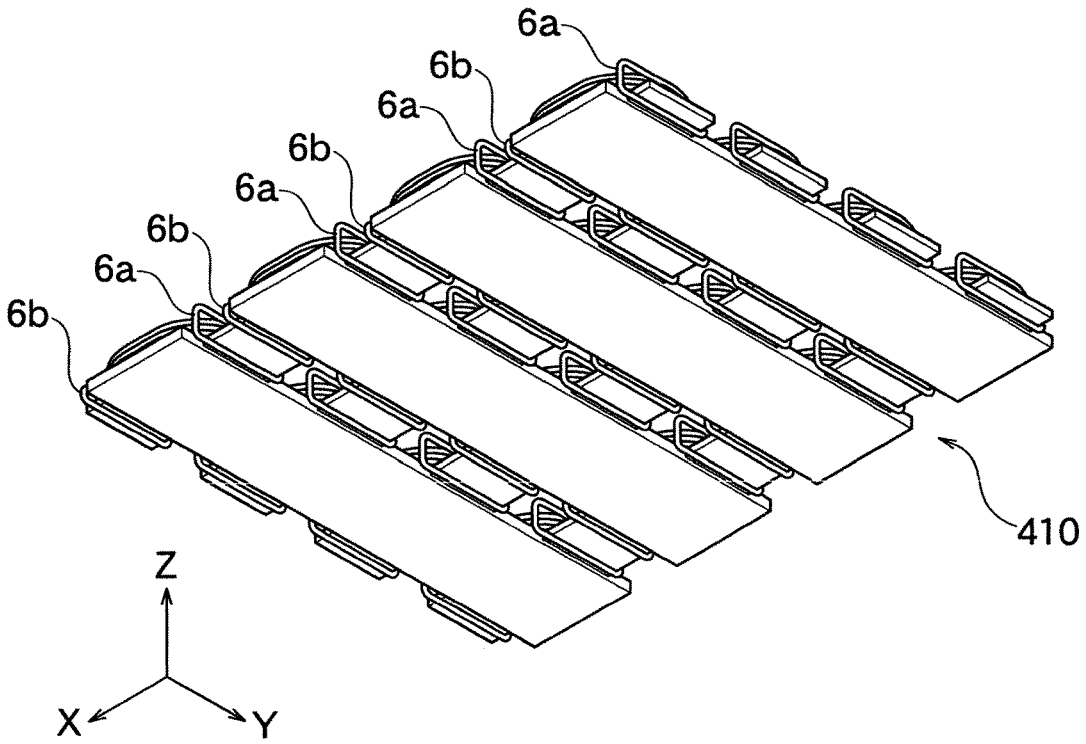

Next, the coil portions 6α are placed on the first-layer molded body 410 so that the lead-out parts 6*a* and 6*b* are arranged on the bottom surface (coil placement step). For more detail, as shown in FIG. 2B(a) and FIG. 2B(b), the coil portions 6α are placed on the support portion 410*a* of the first-layer molded body 410 so that the winding cores 410*b* are arranged in the coil portions 6α. Incidentally, the coil portions 6α may be placed on the support portion 410*a* of the first-layer molded body 410 by winding the wires 6 around the winding cores 410*b*.

Next, the lead-out parts 6*a* and 6*b* of the coil portions 6α are aligned to substantially be parallel to each other, drawn in the Y-axis direction by a predetermined distance, bent in the Z-axis direction, and drawn in the Z-axis direction by a predetermined distance. Moreover, the lead-out parts 6*a* and 6*b* are bent in the Y-axis direction, drawn in the Y-axis direction by a predetermined distance, and arranged on the steps 410*d*. As a result, the lead-out parts 6*a* and 6*b* partially protrude downward from the bottom surface of the support portion 410*a*.

Figure 2C:
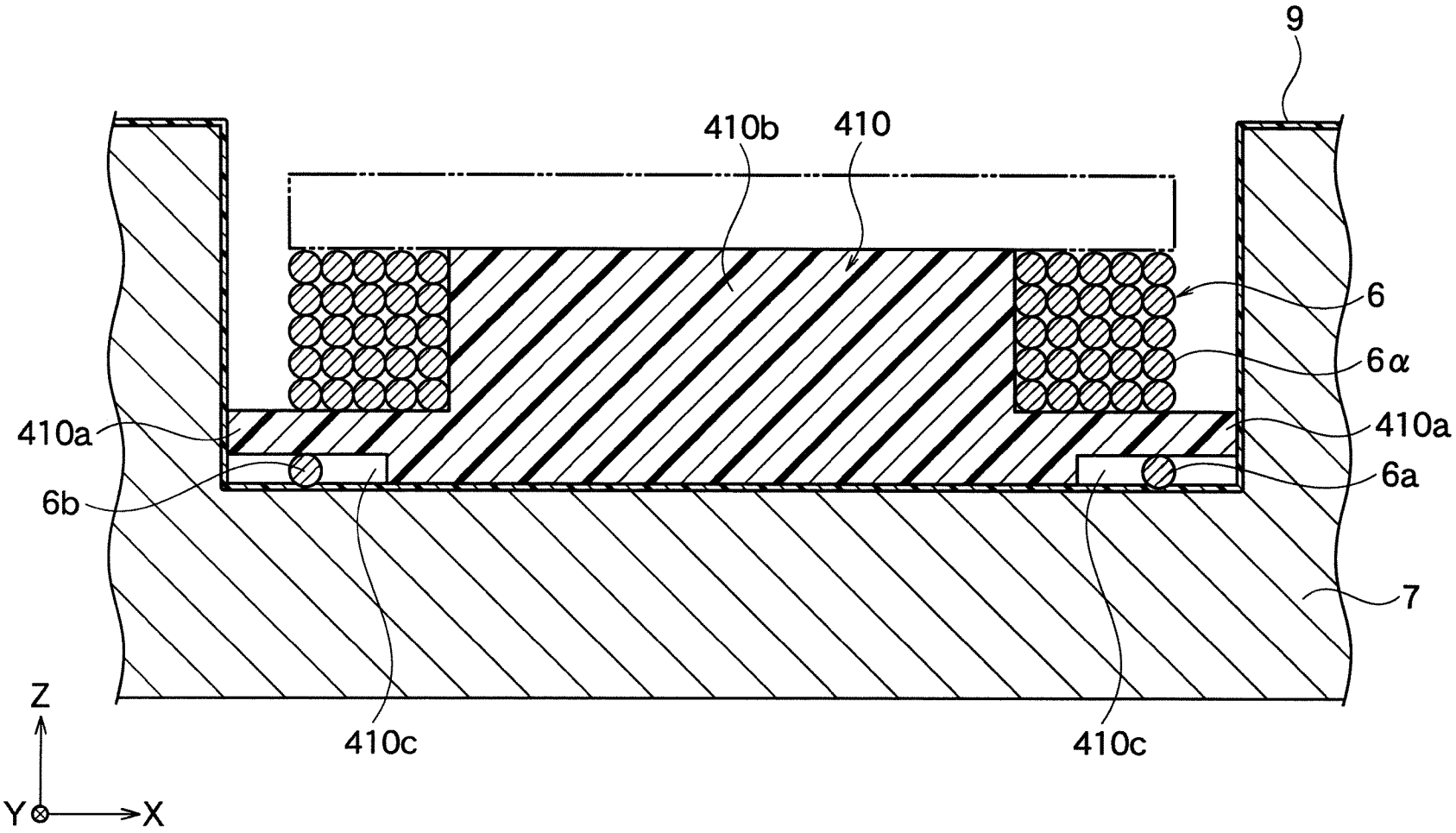
FIG. 2C is a cross-sectional view showing the next step of FIG. 2B(a) and FIG. 2B(b).

Next, as shown in FIG. 2C, the first-layer molded body 410 with the coil portions 6α is disposed on the molding die 7. A release film (sheet) 9 is previously attached on an inner surface of a cavity of the molding die 7. The release film 9 is a flexible sheet-like member of PET film or so. Incidentally, FIG. 2C illustrates the first-layer molded body 410 with only the single winding core 410*b* for easy explanation, but the first-layer molded body 410 with the multiple winding cores 410*b* may be disposed in the die 7.

In the present embodiment, a part of the lead-out parts 6*a* and 6*b* of the coil portion 6α is arranged at the lower part of the first layer 41 (support portion 41*a*) as shown in FIG. 1B, and the part of the lead-out parts 6*a* and 6*b* thereby bites into by the release film 9 in arranging the lead-out parts 6*a* and 6*b* of the coil portions 6α on the release film 9. Thus, the release film 9 is deformed by following the outer circumference shape of the lead-out part 6*a* and 6*b* and is closely attached to the lead-out parts 6*a* and 6*b*. As a result, the part (part protruding downward from the support portion 410*a*) of the lead-out parts 6*a* and 6*b* is covered with the release film 9.

Figure 2D:
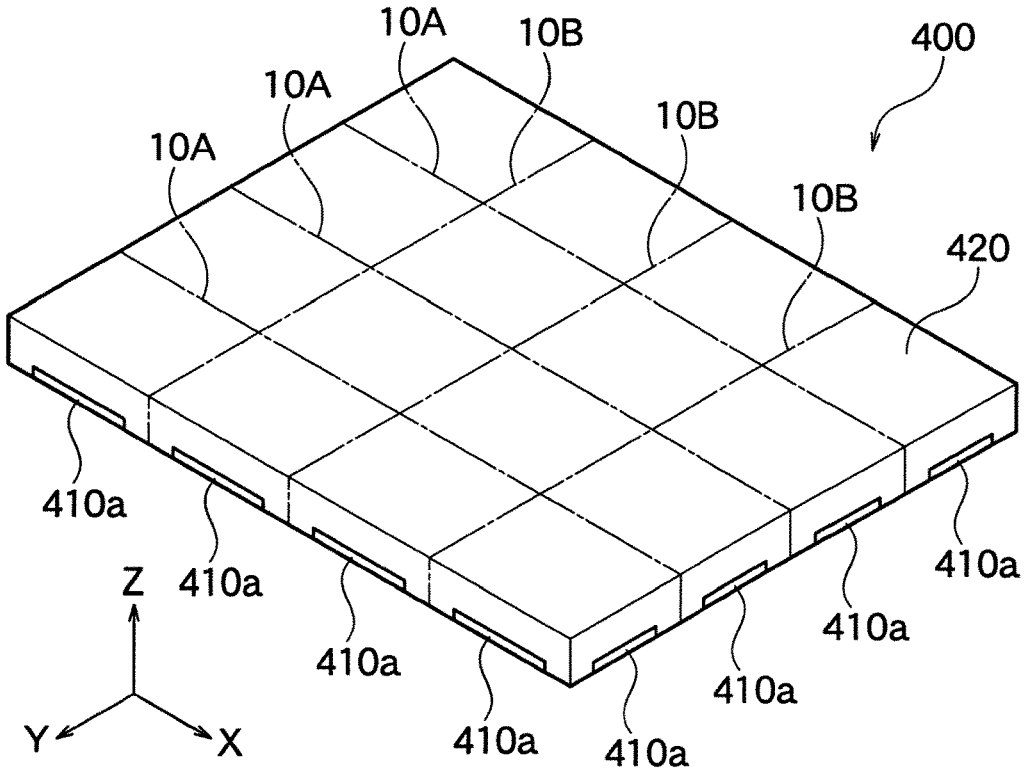
FIG. 2D(a) and FIG. 2D(b) are a cross-sectional view showing the next step of FIG. 2C.
Figure 2D:
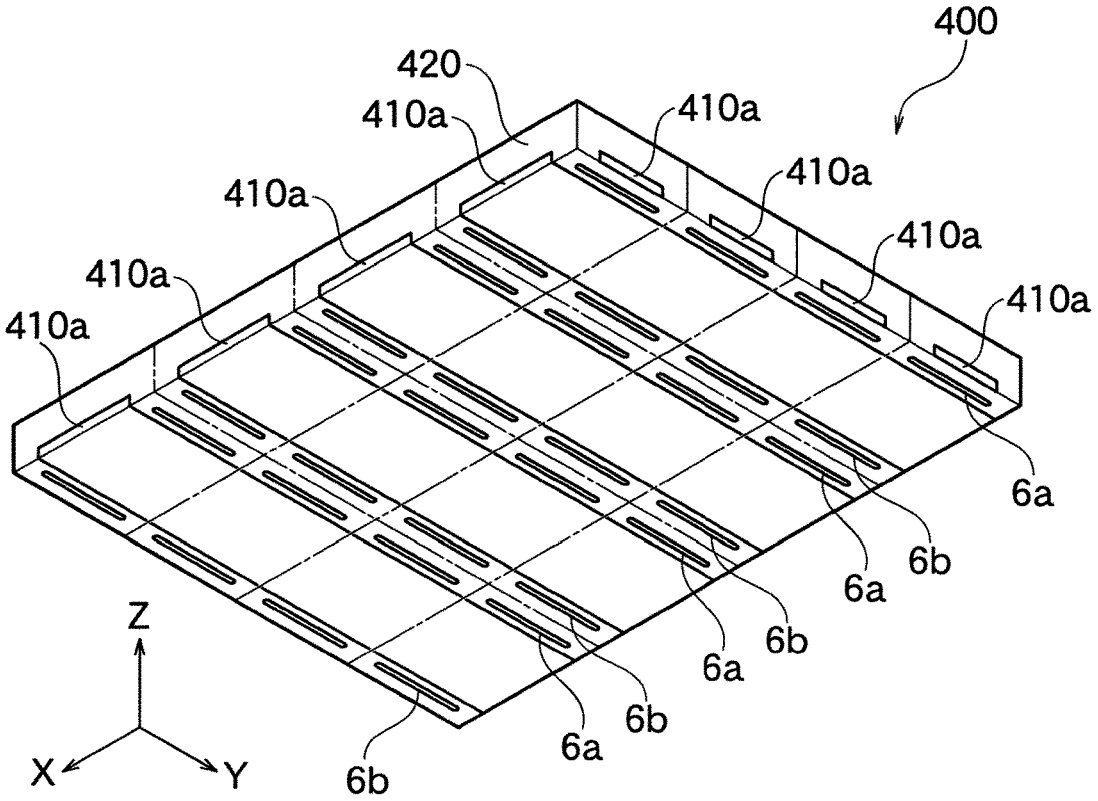

Next, the first-layer molded body 410 is covered with the second layer 420 so that the outer circumferences of the lead-out parts 6*a* and 6*b* are partially exposed, and a substrate 400 (see FIG. 2D(a) and FIG. 2D(b)) constituted by the first-layer molded body 410 and the second layer 420 is formed (substrate formation step). The second layer 420 is molded by any method. For example, the second layer 420 is molded by insert injection where the first-layer molded body 410 is disposed in the die 7. This molding allows a molding material constituting the second layer 420 to flow from the front surface to the rear surface of the molded body 410 via the notches 410*c* and the through holes 410*e* and to go over the inside of the steps 410*d*.

That is, a part of the molding material constituting the second layer 420 is configured to be filled in the space between the release film 9 of the steps 410*d* via the notches 410*c* or the through holes 410*d*. At this time, a resin constituting the second layer 420 does not attach to a part of the outer circumferences of the lead-out parts 6*a* and 6*b* covered with the release film 9. That is, the resin does not unnecessarily reach the space between the steps 410*d* and release film 9 and does not entirely cover the outer circumferences of the lead-out parts 6*a* and 6*b* in the present embodiment. Thus, it is possible to form the substrate 400 where the outer circumferences of the lead-out parts 6*a* and 6*b* are partially exposed (see FIG. 2D(b)).

Incidentally, even if the outer circumferences of the lead-out parts 6*a* and 6*b* are entirely covered with the resin constituting the second layer 420, the outer circumferences of the lead-out parts 6*a* and 6*b* can partially be exposed by polishing the bottom surface of the substrate 400 flat.

The material constituting the second layer 420 is a flexible material at molding, and is a composite magnetic material containing a binder of thermoplastic resin, thermosetting resin, etc. Incidentally, the material of the molding die 7 may appropriately be determined from any material that is bearable for the pressure during molding, such as plastic and metal Next, as shown in FIG. 2D(a) and FIG. 2D(b), the substrate 400 is taken out from the molding dire 7, cut along cut-scheduled lines 10A extending in the X-axis direction and cut-scheduled lines 10B extending in the Y-axis direction, and divided into 16 pieces (cutting step). As a result, the element body 4 containing the single coil portion 6α is obtained as shown in FIG. 1A. The substrate 400 is cut by any method, such as laser or cutting tools of dicing saws, wire saws, etc. From the viewpoint of easy cutting, a dicing saw having a sharp cut surface is preferably used.

Next, as shown in FIG. 1B, the terminal electrodes 8*a* and 8*b* are formed on the bottom surface 4*b* of the element body 4 containing the wire 6 by pasting method and/or plating method, and are subjected to a dry treatment or a heat treatment as necessary (terminal-electrode formation step). Incidentally, the terminal electrodes 8*a* and 8*b* are preferably formed by sputtering or screen printing using silver paste. This is because these methods enable the terminal electrodes 8*a* and 8*b* to be formed thin.

In the terminal-electrode formation step, the terminal electrodes 8*a* and 8*b* are formed on the bottom surface 4*a* of the element body 4 so as to cover the side surface 4*c* to the side surface 4*d* of the element body 4 and so as to be connected with a part of the outer circumferences of the lead-out parts 6*a* and 6*b* of the wire 6 exposed from the bottom surface 4*b* (bottom surface of the second layer 42) of the element body 4.

Incidentally, the terminal electrodes 8*a* and 8*b* continuously cover the intersection between the top surface 4*a* and the side surface 4*c* of the element body 4 to even the intersection between the top surface 4*a* and the side surface 4*d* of the element body 4 in the example of FIG. 1A, but may intermittently cover the intersection between the top surface 4*a* and the side surface 4*c* of the element body 4 to the intersection between the top surface 4*a* and the side surface 4*d* of the element body 4.

According to the above-mentioned method, it is possible to effectively produce the element body 4 where the outer circumferences of the lead-out parts 6*a* and 6*b* of the coil portion 6α are partially exposed from the bottom surface of the second layer 42 and to improve production efficiency of the inductor 2 of the present embodiment.

In the above-mentioned method, the steps are carried out in the order of the cutting step, the terminal-electrode formation step, and the barrel polishing step after obtaining the substrate (molded body) 400 containing a plurality of coil portions 6α, but the cutting step may be carried out after the terminal-electrode formation step.

That is, as shown in FIG. 2D(a) and FIG. 2D(b), the element body 4 may be formed by cutting the substrate 400 (cutting step) after terminal electrode patterns are formed in the Y-axis direction on the bottom surface of the substrate 400 (first-layer molded body 410 and second layer 420) so as to be connected with a part of the outer circumferences of the lead-out parts 6*a* and 6*b* exposed from the bottom surface of the second layer 420 (terminal-electrode formation step). The above-mentioned method can improve production efficiency of the inductor 2 having the element body 4 with the terminal electrodes 8*a* and 8*b*.

In the inductor 2 of the present embodiment, a substantially half or more of the lead-out parts 6*a* and 6*b* is embedded in the element body 4, and there hardly exists an exposed portion of the lead-out parts 6*a* and 6*b* from the bottom surface 4*a* of the element body 4, on the transverse plane perpendicular to the longitudinal direction of the lead-out parts 6*a* and 6*b*. Thus, the lead-out parts 6*a* and 6*b* do not unnecessarily protrude from the bottom surface 4*a* of the element body 4, and a low profile of the inductor 2 can be achieved.

A part of the lead-out parts 6*a* and 6*b* exposed from the bottom surface 4*b* of the element body 4 is covered with the terminal electrodes 8*a* and 8*b* and electrically connected therewith. That is, unlike the prior arts, the terminal electrodes 8*a* and 8*b* are namely not formed to be put into a recess on the bottom surface 4*b* of the element body 4 in the inductor 2 of the present embodiment. Thus, the volume reduction of the element body 4, which functions as a core, is small, degradation of magnetic properties is small, and a low profile of the inductor 2 can be achieved.

The element body 4 includes the first layer 41 having the support portion 41*a* configured to support the coil portion 6α. Thus, the coil portion 6α is supported by the support portion 41*a*, and a positional displacement of the coil portion 6α can effectively be prevented in the element body 4.

The element body 4 has the winding core 41*b* formed on the surface of the support portion 41*a* and configured to be positioned inside the coil portion 6α. Thus, the coil portion 6α is supported by the support portion 41*a*, and a positional displacement of the coil portion 6α can effectively be prevented in the element body 4.

The steps 41*d*1 and 41*d*2 configured to accommodate the lead-out parts 6*a* and 6*b* are formed on the bottom surface of the support portion 41*a* opposite to the front surface 41*a*6 configured to support the coil portion 6*a*, and the height H of the steps 41*d*1 and 41*d*2 is smaller than the outer diameter L of the lead-out parts 6*a* and 6*b*. In this structure, when the lead-out parts 6*a* and 6*b* of the coil portion 6*a* are arranged on the steps 41*d*1 and 41*d*2, the outer circumferences of the lead-out parts 6*a* and 6*b* partially protrude downward from the bottom surface of the support portion 41*a*. For example, when the second layer 42 is filled in the steps 41*d*1 and 41*d*2 so as to be flush with the bottom surface of the support portion 41*a*, it is possible to form the element body 4 where a part of the outer circumferences of the lead-out parts 6*a* and 6*b* is exposed from the bottom surface of the second layer 42 and becomes the exposed portions 6*a*1 and 6*b*1. The exposed portions 6*a*1 and 6*b*1, which are part of the outer circumferences of the lead-out parts 6*a* and 6*b*, are covered with the terminal electrodes 8*a* and 8*b* and electrically connected therewith.

Moreover, the element body 4 includes the second layer 42 whose permeability is smaller than permeability of the first layer 41. In this structure, magnetic saturation characteristics of the element body 4 can be improved. The material constituting the second layer 42 having a small permeability has good flexibility and formability and can be filled in small spaces (i.e. the steps 41*d*1 and 41*d*2). Moreover, since the first layer 41 has a large permeability, magnetic properties, such as inductance, of the element body 4 can be improved.

Incidentally, the present invention is not limited to the above-mentioned embodiment, and may be changed variously within the scope of the present invention. For example, the wire 6 has a winding shape of elliptical spiral in the above-mentioned embodiment, but the wire 6 may have a winding shape of circular spiral, square spiral, concentric circle, or the like.

Incidentally, the wire 6 may be a copper or silver wire covered with enamel, and may be a rectangular wire shown in FIG. 1D. The wire 6 is not limited to a wire covered with an insulating film, and may be a wire that is not covered with an insulating film. The wire 6 is not limited to a round wire, and may be a rectangular wire (flat wire) as shown in FIG. 1D, a square wire, or a litz wire. The core of the wire 6 is not limited to copper or silver, and may be an alloy containing them, another metal or alloy, or the like.

Preferably, the wire 6 is a wire covered with an insulating film. This is because even if metal magnetic particles are dispersed in a main component constituting the element body 4, there is less risk of short circuit between a core wire and the metal magnetic particles of the element body 4, withstand voltage characteristics are improved, and deterioration of inductance is prevented.

EXAMPLE

Hereinafter, the present invention is described based on more detailed examples, but is not limited thereto.

Example

Manufactured were an inductor 2 (Example) where a step 41*d* was filled with a second layer 42 and an inductor (Comparative Example) where a step 41*d* was not filled with a second layer 42. The size of the inductors was 3.2 mm×2.5 mm×1.0 mm. The inductance value of the inductor 2 of Example was 11.52 μH, and the inductance value of the inductor of Comparative Example was 10.90 μH. That is, it was clear that the inductance value of the inductor 2 of the present embodiment was improved by 5.4%, compared to the inductor of Comparative Example.

NUMERICAL REFERENCES

2 . . . inductor (coil device)
4 . . . element body
40 . . . substrate
41 . . . first layer
41*a*, 410*a* . . . support portion
41*a*1 . . . first flange
41*a*2 . . . second flange
41*a*3 . . . third flange
41*a*4 . . . fourth flange
41*b*, 410*b* . . . winding core
41*c*, 410*c* . . . notch
41*c*1 . . . first notch
41*c*2 . . . second notch
41*c*3 . . . third notch
41*c*4 . . . fourth notch
41*d*, 410*d* . . . step
41*d*1 . . . first step
41*d*2 . . . second step
410*e* . . . through hole
42 . . . second layer
6 . . . wire
6α . . . coil portion
6*a*, 6*b* . . . lead-out part
7 . . . molding die
8*a*, 8*b* . . . terminal electrode
9 . . . release film
10A, 10B . . . cut-scheduled line
410 . . . first-layer molded body
420 . . . second-layer molded body

The invention claimed is:

1. A coil device, comprising:

a coil portion formed by a wire wound in a coil shape;

an element body containing the coil portion where a part of an outer circumference of a lead-out part of the coil portion is exposed as an exposed portion from a bottom surface of the element body and where the rest of the outer circumference of the lead-out part of the coil portion is embedded as an embedded portion in the element body; and a terminal electrode formed on the bottom surface of the element body and connected with the exposed portion, wherein an embedded length of the outer circumference of the lead-out part in the embedded portion is larger than a substantially half of a full length of the outer circumference of the lead-out part, the element body comprises a first layer having a support portion configured to support the coil portion, a step configured to accommodate the lead-out part is formed on a bottom surface of the support portion opposite to a front surface of the support portion configured to support the coil portion, and a height of the step is smaller than a diameter of the lead-out part.

2. The coil device according to claim 1, wherein an exposed length of the outer circumference of the lead-out part in the exposed portion is smaller than the substantially half of the full length of the outer circumference of the lead-out part.

3. The coil device according to claim 1, wherein the element body comprises a winding core formed on the front surface of the support portion and configured to be positioned inside the coil portion.

4. The coil device according to claim 2, wherein the element body comprises a winding core formed on the front surface of the support portion and configured to be positioned inside the coil portion.

5. The coil device according to claim 1, wherein the element body comprises a second layer whose permeability is smaller than that of the first layer.

6. The coil device according to claim 2, wherein the element body comprises a second layer whose permeability is smaller than that of the first layer.

7. The coil device according to claim 3, wherein the element body comprises a second layer whose permeability is smaller than that of the first layer.

8. The coil device according to claim 1, wherein:

the lead-out part comprises a first lead-out part and a second lead-out part extending substantially in parallel to the first lead-out part;

the step comprises a first step and a second step;

the first lead-out part extends along the first step; and the second lead-out part extends along the second step.

9. The coil device according to claim 3, wherein:

the lead-out part comprises a first lead-out part and a second lead-out part extending substantially in parallel to the first lead-out part;

the step comprises a first step and a second step;

the first lead-out part extends along the first step; and the second lead-out part extends along the second step.

10. The coil device according to claim 5, wherein:

the lead-out part comprises a first lead-out part and a second lead-out part extending substantially in parallel to the first lead-out part;

the step comprises a first step and a second step;

the first lead-out part extends along the first step; and the second lead-out part extends along the second step.

11. A coil device, comprising:

a coil portion formed by a wire wound in a coil shape;

an element body containing the coil portion where a part of an outer circumference of a lead-out part of the coil portion is exposed as an exposed portion from a bottom surface of the element body and where the rest of the outer circumference of the lead-out part of the coil portion is embedded as an embedded portion in the element body; and a terminal electrode formed on the bottom surface of the element body and connected with the exposed portion, wherein an embedded length of the outer circumference of the lead-out part in the embedded portion is larger than a substantially half of a full length of the outer circumference of the lead-out part, a step configured to accommodate the lead-out part is formed on a bottom surface of the element body, and a height of the step is smaller than a diameter of the lead-out part.

12. A coil device, comprising:

a coil portion formed by a wire wound in a coil shape;

an element body containing the coil portion where a part of an outer circumference of a lead-out part of the coil portion is exposed as an exposed portion from a bottom surface of the element body and where the rest of the outer circumference of the lead-out part of the coil portion is embedded as an embedded portion in the element body; and a terminal electrode formed on the bottom surface of the element body and connected with the exposed portion, wherein an embedded length of the outer circumference of the lead-out part in the embedded portion is larger than a substantially half of a full length of the outer circumference of the lead-out part, the element body comprises a first layer having a support portion configured to support the coil portion, a step configured to accommodate the embedded portion is formed on a bottom surface of the support portion opposite to a front surface of the support portion configured to support the coil portion, a filling layer forming a part of the element body is filled in the step, and the embedded portion is covered with the filling layer.

* * * * *